United States Patent [19]

White et al.

[11] 4,347,020

[45] Aug. 31, 1982

[54] MINE ROOF BOLT ASSEMBLY

[75] Inventors: Claude C. White, Birmingham; Frederick Carr, Tuscaloosa, both of Ala.

[73] Assignees: Birmingham Bolt Company; Jim Walter Resources, Inc., both of Birmingham, Ala.

[21] Appl. No.: 109,189

[22] Filed: Jan. 2, 1980

[51] Int. Cl.[3] ..... E21D 20/02

[52] U.S. Cl. ..... 405/260; 405/259; 411/5

[58] Field of Search ..... 405/260, 261, 262, 259; 85/61, 62, 32 R, 35; 411/2, 5

[56] References Cited

U.S. PATENT DOCUMENTS

| | | | |
|---|---|---|---|
| 3,351,214 | 11/1967 | Herbert | 85/62 X |
| 3,357,730 | 12/1967 | Siler | 85/61 X |
| 3,460,428 | 8/1969 | Charles | 85/61 |
| 3,602,976 | 9/1971 | Grube | 85/61 X |
| 3,728,933 | 4/1973 | Grube | 85/61 |
| 3,742,583 | 7/1973 | Devlin et al. | 411/2 |
| 3,854,372 | 12/1974 | Gutshall | 85/62 X |
| 3,877,235 | 4/1975 | Hill | 405/261 |
| 3,896,627 | 7/1975 | Brown | 85/61 X |
| 3,979,918 | 9/1976 | Vidler | 405/261 |
| 4,023,373 | 5/1977 | Hipkins | 405/261 |
| 4,295,761 | 10/1981 | Hansen | 405/261 |

FOREIGN PATENT DOCUMENTS

| | | | |
|---|---|---|---|
| 1187669 | 9/1959 | France | 405/259 |

*Primary Examiner*—Dennis L. Taylor

*Attorney, Agent, or Firm*—Shlesinger, Arkwright, Garvey & Dinsmore

[57] ABSTRACT

A mine roof bolt assembly including a shank having anchoring means at one end for securing the shank in the back of the bore, the opposite end of the shank being threaded. A bolt head having a central bore, includes a first threaded bore portion threadedly engaged with the threaded end of the shank. A stop plug is threaded into a second threaded bore portion in the bolt head and abuts an end of the shank to initially limit penetration of the shank into the bore of the head. The bolt head is rotated by rotational means having a predetermined torque limit, moving the head longitudinally with respect to the shank, exerting a force on the stop plug which strips the threads from the second threaded bore portion, thereby permitting uninterrupted passage of the shank through the bore. A roof plate positioned on the shank between the bolt head and roof is then forced upwardly by the head into supporting engagement with the mine roof, and the predetermined torque of the rotational means is established.

18 Claims, 13 Drawing Figures

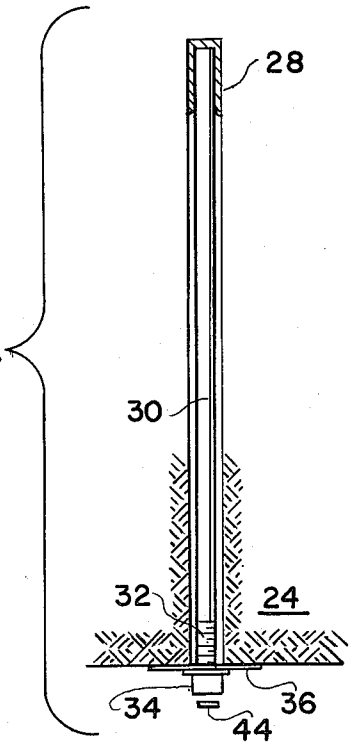
Fig 4
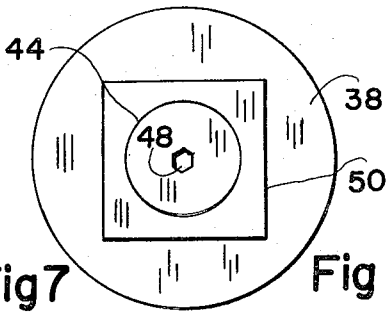
Fig 8
Fig 7
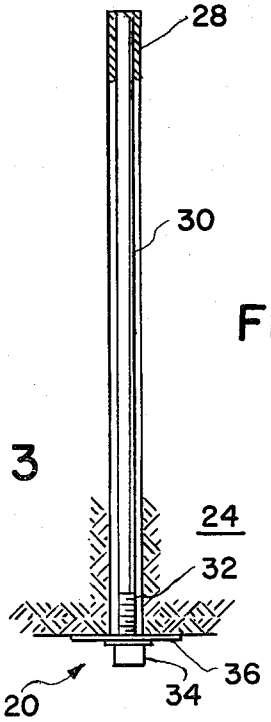
Fig 3
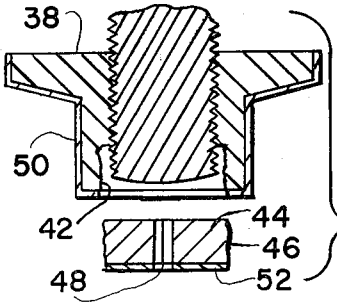
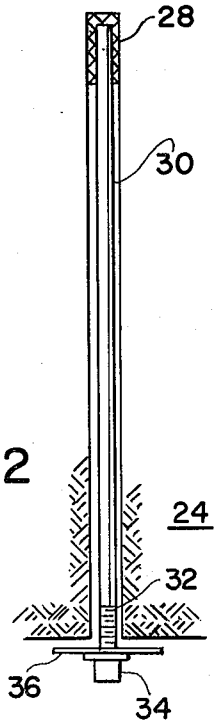
Fig 2
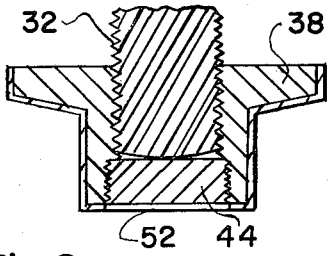
Fig 6
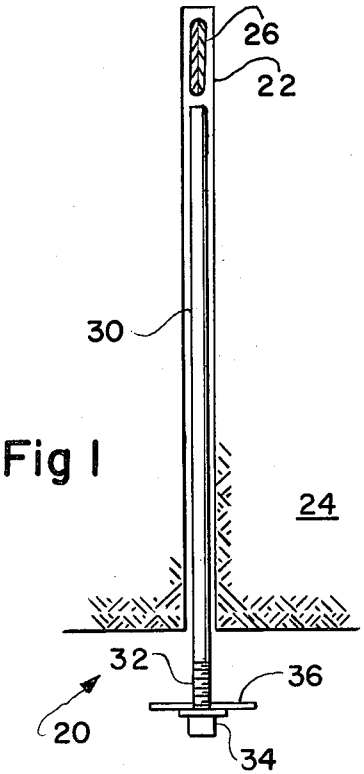
Fig 1
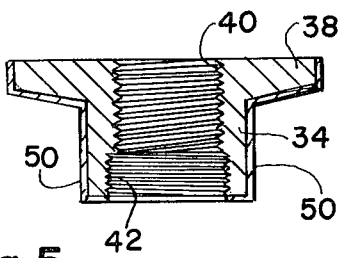
Fig 5

MINE ROOF BOLT ASSEMBLY

BACKGROUND OF THE INVENTION

This invention relates to anchor bolts which are installed in mine roofs for support purposes.

In the installation of mine roof bolts, such as point anchor resin bolts, a resin capsule is inserted into a vertical bore in the mine roof and the bolt is inserted into the bore for pushing the capsule to the back of the bore. Continued upward pressure by the bolt fractures the capsule and the bolt is rotated to mix the resin components. The resin is then permitted to harden to secure the bolt in the bore. After the resin hardens, it is necessary that the roof support plate associated with the bolt assembly be moved into supporting engagement with the mine roof.

Various means have been devised to accomplish this purpose by providing structural parts on the roof bolt which are adapted to break away when sufficient force is applied to the bolt head, thereby permitting the roof bolt and support plate to move upwardly into engagement with the mine roof. Illustrative of such structures are those disclosed in U.S. Pat. Nos. 3,979,918 and 4,023,373. Although these prior devices all are concerned with the present problem, they do not accomplish this purpose in the simple and inexpensive manner necessary to render the manufacture thereof economically feasible nor can they be produced with such consistency that they can break away at a precise torque.

It should further be noted that many roof bolts are ineffective because they are not installed properly, the resin is not mixed completely, or the head of the bolt seizes on the plate, and the torque is lost overcoming this friction. Additionally, the operators of machines used to install roof bolts are commonly unaware that their machines have lost the power to tighten bolts to the desired torque. This is due to reduced voltage in the power supply, wear on the machines, and inaccurate and erroneous settings of hydraulic pressures. Also, the friction between bolt heads and plates varies widely due to varying thrust of the bolting machine.

SUMMARY OF THE INVENTION

The present invention is a mine roof bolt assembly having incorporated therein simple and economic means for pretesting the anchorage and installation torque available prior to tightening the bolt after it has been initially secured in position by anchor means, drawing the bolt head towards the mine roof to force the roof plate into supporting engagement with the mine roof.

In accordance with this invention, a bolt head of nutlike configuration is provided, the head having a central bore including a first threaded bore portion which is threadedly engaged with a threaded end at the bolt shank. A stop plug is threadedly engaged with a second threaded bore portion in the head which is aligned with the first threaded bore portion.

The stop plug abuts an end of the shank to initially limit the penetration of the shank into the head. Upon application of a predetermined torque to the head, the force exerted on the stop plug by the shank strips the threads of the second threaded bore portion, forcing the stop plug out of the head bore and allowing the bolt head and roof plate to be advanced toward the mine roof for supporting engagement therewith. By providing a stop plug threaded in a bore portion, the torque required on the head to disengage the plug from the bore portion can be accurately set and controlled, and proper installation of the roof bolt may be effected without the use of extraneous parts or expensive modification of existing structure due to pre-anchorage and available installation torque testing.

The present invention further provides a visual indication that the roof bolt assembly has been properly installed and that the proper level of installation torque is produced by the bolting machine, by providing a stop plug in the bolt head which is forced from the bolt head during the final step of the installation procedure. The absence of the stop plug visually indicates that the machine installing the bolt applied a preselected torque to the bolt shank, regardless of any unusual friction between the head of the bolt and the plate, and that the resin anchorage is capable of sustaining the torque.

With the assembly of the present invention, a standard bolt shank, one end of which is threaded, may be used, and the bolt head engageable therewith is similar in configuration to the head of a conventional mine roof bolt. The threaded bores within the bolt head may be quickly and accurately made and the stop plug is of simple construction and readily assembled in the bolt head.

BRIEF DESCRIPTION OF THE DRAWINGS

FIG. 1 is an elevational view of the mine roof bolt assembly of the present invention illustrating the first step in the installation thereof in the mine roof bolt.

FIG. 2 is a view similar to FIG. 1, and illustrating the second step in the installation of the mine roof bolt assembly of the present invention.

FIG. 3 is a view similar to FIG. 1 showing the third step in the installation of the mine roof bolt assembly of the present invention.

FIG. 4 is a view similar to FIG. 1 showing the final step in installation of the mine roof bolt of the present invention.

FIG. 5 is an enlarged longitudinal sectional view of the bolt head forming a part of the present invention.

FIG. 6 is a view similar to FIG. 5 showing the threaded shank and stop plug engaged therein.

FIG. 7 is a view similar to FIG. 6 illustrating the position of the threaded shank and the stop plug with respect to the bolt head during the final steps of the installation of the mine roof bolt assembly in the mine roof.

FIG. 8 is an end elevational view of the bolt head and stop plug illustrated in FIG. 6.

DESCRIPTION OF THE FORM OF INVENTION ILLUSTRATED IN FIGS. 1 TO 8

Figures 9, 10, 11, 12, 13:
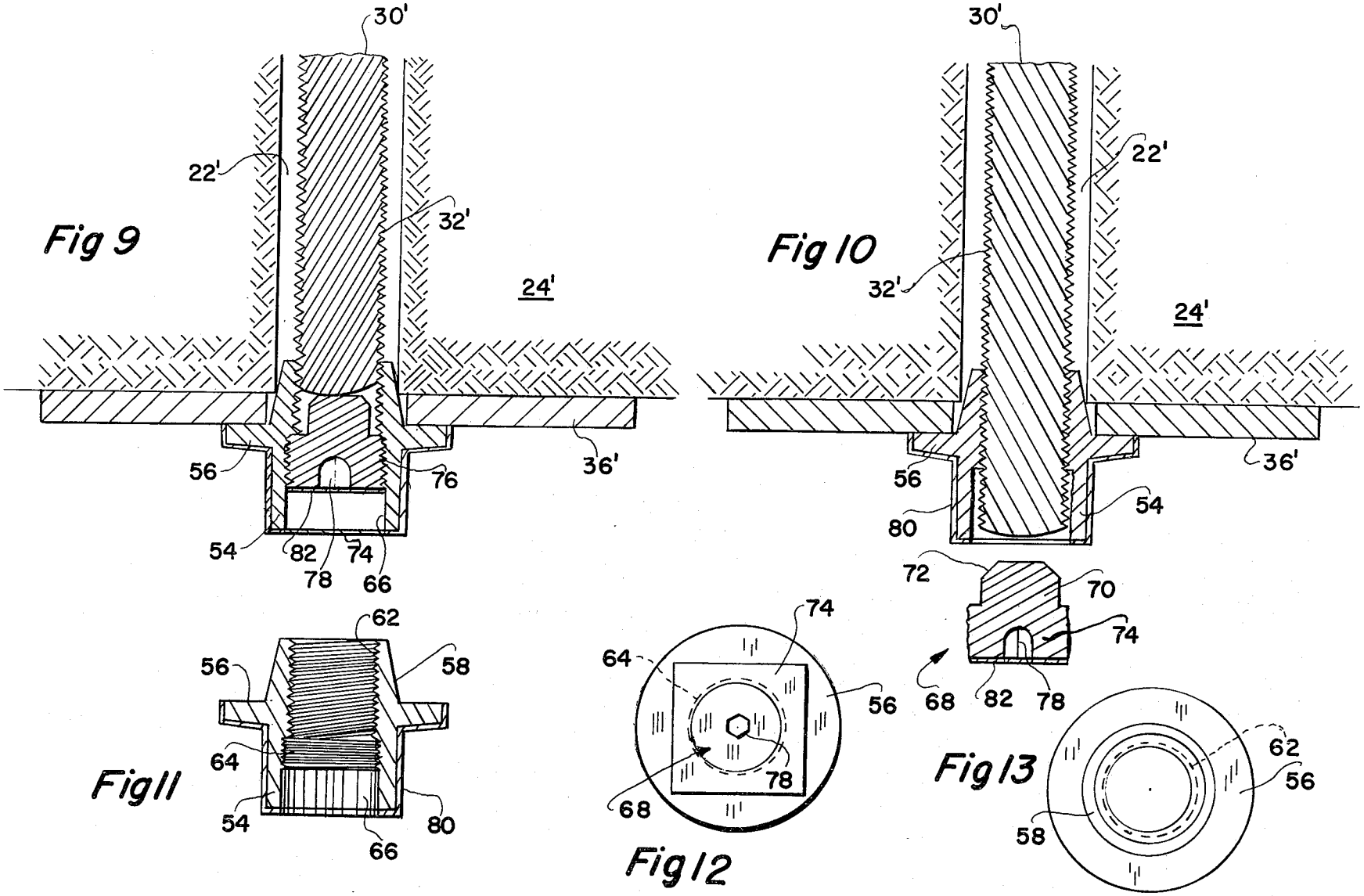
FIG. 9 is an enlarged fragmentary sectional view illustrating a modified form of the present invention prior to the final step of the installation of the mine roof bolt.
FIG. 10 is a view similar to FIG. 9 illustrating the position of the parts of the assembly after the final installation procedure.
FIG. 11 is a longitudinal sectional view of the modified form of the bolt head illustrated in FIG. 9.
FIG. 12 is an end elevational view of the bolt head illustrated in FIG. 11.
FIG. 13 is an end elevational view of the bolt head of FIG. 11 as viewed from the end opposite to that shown in FIG. 12.

In FIGS. 1 to 8, there is illustrated the presently preferred form of this invention. The mine roof bolt assembly is generally designated 20 and is adapted for installation in an elongated bore 22 of a mine roof 24. In accordance with one usage of this invention, a resin capsule 26 is inserted into the bore and pushed to the back end thereof by the bolt shank, which capsule is adapted to be fractured to provide a resin mixture 28 which hardens to securely hold the inner end of the roof bolt assembly in position.

Roof bolt assembly 20 includes a shank 30, one end of which is threaded at 32 for engagement with a bolt head 34. A conventional roof plate is indicated at 36.

As shown to advantage in FIG. 5, bolt head 34 includes a main body portion which is of nutlike configuration, one end of which is enlarged to provide a peripheral flange 38 which is uniplanar with a body terminal.

In accordance with the objects of the present invention, there is provided a first threaded bore portion 40 which is preferably a right hand thread, which threaded bore portion threadedly engages the threaded end 32 of shank 30 as shown to advantage in FIG. 6. A second threaded bore portion is indicated at 42 which threaded bore portion preferably comprises threads which are finer than those of threaded bore portion 40, and the diameter of the second threaded bore portion is slightly larger than that of the first threaded bore portion 40. The threads of second bore portion 42 are preferably opposite hand from those of first threaded bore portion 40, i.e. left hand, for reasons which will hereinafter be more fully set out.

A stop plug 44 of disk shape having a threaded periphery 46 is threadedly engaged with second threaded bore section 42 to position the stop plug in engagement with an end of shank 30, as illustrated in FIG. 6. A central cavity 48 of hexagonal or other suitable cross section facilitates assembly of the stop plug in the second threaded bore section by means of a standard wrench.

In order to provide a visual indication of whether conditions for proper installation of the bolt assembly have been met, the exterior surfaces of bolt head 34 and stop plug 44 are coated with paint of different, contrasting colors, which may be reflective or non-reflective, as indicated at 50 and 52, the absence of the stop plug giving an immediate visual indication that the circumstances for proper installation were attained.

In use of the mine roof bolt assembly of the present invention, resin capsule 26 is inserted into the bore and moved upwardly therein to the back of the bore by an end of the mine roof bolt. Upon continued longitudial movement of the bolt through the bore, capsule 26 is fractured and the bolt shank 30 and head 34 are then rotated together and thurst upwardly in the hole as shown to advantage in FIG. 2, to effect mixing of the resin components. During the rotation of the bolt, relative rotation of head 34 with respect to shank 30 is prevented by engagement of shank 30 with stop plug 44. At this point, roof plate 36 is within one-half inch of the roof as illustrated in FIG. 2. After rotating for five to ten seconds, the bolt is thrust upwardly in the bore until roof plate 46 is in contact with the mine roof. The bolt is held in this position for five to twenty seconds in order to permit the resin to set.

Bolt head 34 is then subjected to machine rotation and, since the resin has set to prevent rotational movement of shank 30, the exertion of a predetermined torque on the bolt head exerts a force on the shank 30 which is transmitted to stop plug 44, causing the latter to strip the threads of second threaded bore portion 42, forcing the plug out of the second bore section and permitting further rotation of the nut head until the desired force is exerted by roof plate 36 on the roof. This effects deeper penetration of threaded shank 32 into first threaded bore portion 28 and, as shown to advantage in FIG. 7, the threaded shank is free to pass uninterruptedly through the second bore portion by virtue of the enlarged diameter of that area and the threads of the second bore portion.

The provision of opposite handed threads in the two bore sections precludes unscrewing of the stop plug which could occur with threads of the same hand, when the end of the threaded shank frictionally engages the rotating stop plug. By this arrangement, therefore, the desired stripping action of the second bore portion by the stop plug is assured.

DESCRIPTION OF THE FORM OF INVENTION ILLUSTRATED IN FIGS. 9 TO 13

In FIGS. 9 to 13, there is illustrated a modified form of the invention illustrated in FIGS. 1 to 8. In this modified form, the structure of the bolt shank and roof plate are the same as shown in the preferred form of the invention, and, accordingly, like parts are indicated by a like, primed numbers.

Referring now to FIGS. 9 to 11, the bolt head in the modified form of the invention includes a body portion of nutlike configuration 54 which issues into a peripheral flange 56. Beyond peripheral flange 56 there is provided a generally cylindrical body portion 58 having an outer wall 60 which tapers gradually inwardly to the end of said body portion.

In accordance with this form of invention, the bolt head is provided with a central bore including a first threaded bore portion 62 which extends through body portion 58 to a point adjacent peripheral flange 56, which threaded portion preferably comprises a right hand thread. Threaded bore portion 62 threadedly engages the threaded end 32' of shank 30' in the manner shown in FIG. 9. A second threaded bore portion 64 extends through a portion of body portion 54, which threaded bore portion preferably comprises threads which are finer than those of threaded bore portion 62, and the diameter of the second threaded bore portion is slightly larger than that of first threaded bore portion 62. The threads of second bore portion 64 are preferably left hand threads, and opposite hand to those of first threaded bore portion 62. A third portion 66, which is unthreaded and larger in diameter than the second threaded bore portion, is located between second threaded bore portion 64 and the outer end of the stop plug.

A stop plug 68 is inserted into body portion 54 of the bolt head, the stop plug including a cylindrical stop portion 70 which engages and initially limits the movement of shank 32' through the body portion. As shown in FIGS. 9 and 10, the peripheral edge of one end of stop portion 70 is beveled at 72 and the periphery thereof is in spaced relation to the threads of first threaded bore portion 62. The opposite end of cylindrical stop portion 70 is enlarged to provide a disk portion 74, the outer periphery is threaded at 76 for threaded engagement with second threaded bore portion 64. As shown in FIG. 9, when disk portion 74 is in fully threaded engagement with second threaded bore portion 64, the upper limit of stop portion 70 is in abutting engagement with the lower end of shank 32'. The outer face of disk portion 74 is provided with a central cavity 78 of hexagonal, or other suitable cross section, for engagement by a complemental standard wrench for inserting the stop plug into the head bore.

In this form of the invention also, the exterior surfaces of the bolt head and stop plug are coated with paint of different contrasting colors as indicated at 80 and 82 in order to give visual indication of whether or not the bolt assembly is properly installed in the mine roof.

In use of the modified form of the present invention, the installation procedure is substantially the same as set out above in connection with the form of the invention illustrated in FIGS. 1 to 8. However, it will be noted from FIGS. 9 and 10 that, in the modified form of the invention, a portion of the tapering body portion 58 is adapted to fit into bore 22' to center shank 30' in the bore. By locating threads 62 engaged with shank 30' inside the bore, the possibility of the shank protruding excessively from the head, when the head is finally torqued, is minimized. This is desirable when thin seams of ore or coal are being mined, because protruding bolt shanks reduce the height of mining machines which can operate safely without striking them.

By employing a bolt assembly comprising a bolt head having threaded bore portions which can be precision formed in the head, the torque required to disengage the stop plug from the bolt head can be accurately and uniformly predetermined for all assemblies manufactured in accordance with this invention. This obviates the premature rotation of the bolt head with respect to the shank during rotation of the assembly.

As set out above, after the resin has hardened sufficiently to resist rotation of the shank at the break-away torque designed into the bolt head, by rotating the head relative to the shank, the plug is stripped from the head. This indicates that the bolting machine produced ample torque, that the torque was transmitted to the shank of the bolt rather than lost as friction between the head and the plate, and that the resulting tightening of the bolt did not dislodge the resin anchored in the box.

In actual use of the present invention, it has been found that optimum results are obtained with a bolt head first threaded bore section of $\frac{3}{4}$ inch diameter coarse thread, 11 threads per inch, and a second bore section of $\frac{7}{8}$ inch diameter national fine thread, 14 threads per inch, and a stop plug 5/16 inch thickness. With this structural arrangement, a torque of 125–150 ft. lbs. is required to disengage the stop plug from the bolt head by stripping the threads of the second bore section. Changes in this torque can be effected by varying the type and dimensions of the threads in the second bore section and the thickness of the stop plug.

The shank of the present bolt assembly may be made of steel, fiberglass, wood or bamboo and the bolt head and stop plug of steel, cast iron or fiberglass. Although the drawings illustrate the application of the present invention to a point anchor resin bolt, this structure may also be applied to full column resin bolts and to mechanical shell bolts.

While the bolt head of the present invention has been illustrated and described in connection with a resin type bolt assembly, it is to be understood that it may also be employed with a conventional roof bolt and an expansion shell assembly, by providing threads at both ends of the shank, one end being threadedly engaged with the expansion shell and the other end with the bolt head. Various other changes may be made within the scope of the appended claims.

What is claimed is:

1. A mine roof bolt assembly for insertion in a bore in a mine roof, said roof bolt assembly including (a) a shank (b) a first means for anchoring an end of said shank in said mine roof at the back end of the bore (c) a head member having a bore engaged with the opposite end of said shank (d) a second means for permitting rotational movement of said head member with respect to said shank and relative longitudinal movement of the head member with respect to the shank in the direction of the face of the mine roof (e) a third means within the bore of said head member for limiting relative rotational and longitudinal movement of said head member with respect to said shank (f) said third means being disengageable from said head member to allow further rotational and longitudinal movement of said head member with respect to said shank, unimpeded travel of said shank through said head member and upward movement of the head member towards the face of the mine roof, and (g) a fourth means positioned on said shank between said head member and the face of the mine roof, said fourth means being forced upwardly against the face of the mine roof upon movement of the head member towards the face of the mine roof.

2. The mine roof bolt assembly of claim 1, wherein (a) said first means is resin for adhesively securing said shank to the mine roof.

3. The mine roof bolt assembly of claim 1, wherein (a) said second means includes a threaded bore in said head member, and (b) an end of said shank being threaded for threaded engagement with the threaded bore of said head member.

4. The mine roof bolt assembly of claim 1, wherein (a) said third means includes a threaded bore in said head member, and (b) a stop plug threadedly engaged with said threaded bore, said stop plug stripping the threads of said threaded bore portion and gravitating from said head member upon exertion of a predetermined force by said shank.

5. The mine roof bolt assembly of claim 1, wherein (a) said fourth means comprises a roof support plate.

6. A mine roof bolt assembly for insertion in a bore in a mine roof, said roof bolt assembly including (a) a shank (b) anchor means for securing one end of said shank in said mine roof at the back end of the bore (c) the opposite end of said shank being threaded (d) a bolt head having a central bore (e) said bolt head bore having a first threaded portion threadedly engaged with the threaded end of said shank (f) a second threaded portion adjacent said first threaded portion (g) a stop plug threadedly engaged with said second threaded portion and in abutting engagement with said opposite end of said shank for initially limiting penetration of the shank into the bolt head (h) said stop plug gravitating from the bolt head upon application of a predetermined torque to said bolt head, causing the stop plug to strip the second threaded portion of the bolt head, whereby said bolt head moves upwardly toward the face of the mine roof as the threaded end of said shank advances through the bolt head bore, and (i) a support plate positioned on said shank between said bolt head and the face of said mine roof, said support plate being forced upwardly against the face of the mine roof upon movement of the bolt head towards the face of the mine roof.

7. The mine roof bolt assembly of claim 6, wherein (a) said first and second threaded portions comprise opposite hand threads.

8. The mine roof bolt assembly of claim 6, wherein (a) said first and second threaded portions are aligned, and (b) the diameter of said second threaded portion is larger than the diameter of the first threaded portion, whereby said threaded shank may pass uninterruptedly through said second threaded portion when said stop plug strips the threads thereof.

9. The mine roof bolt assembly of claim 8, wherein (a) said bolt head includes a body portion of nutlike configuration, and (b) a flange extending outwardly from the periphery of the body portion for engagement with said fourth means.

10. The mine roof bolt assembly of claim 9, wherein (a) said flange is substantially uniplanar with an end of said body portion.

11. The mine roof bolt assembly of claim 9, wherein (a) said flange is located intermediate the length of said body portion.

12. The mine roof bolt assembly of claim 11, wherein (a) a part of the outer wall of said body portion tapers inwardly from a point adjacent said flange to one end thereof.

13. The mine roof bolt assembly of claim 6, with the addition of (a) coatings of different color applied to the exterior surfaces of said bolt head and stop plug to visually indicate whether the assembly has been properly installed in the mine roof bore.

14. A mine roof bolt assembly for insertion in a bore in a mine roof, said bolt assembly including:

(a) a shank (b) a first means for anchoring an end of said shank in said mine roof at the back end of the bore (c) the opposite end of said shank being threaded (d) a head member having a threaded bore in threaded engagement with said opposite end of said shank for permitting rotational movement of said member with respect to said shank and relative longitudinal movement of the head member with respect to said shank in the direction of the face of the mine roof (e) stop means in the bore of said head member for initially limiting penetration of said shank into said head member (f) a second means for retaining said stop means in the bore of the head member (g) said shank exerting a force on said stop means to overcome said second means and causing said stop means to gravitate from the bore of said head member when a predetermined torque is applied to said head member, thereby allowing unimpeded travel of said shank through said head member, and permitting said head member to move longitudinally of said shank in the direction of the mine roof, and (h) a third means positioned on said shank between said head member and the face of the mine roof, said third means being forced upwardly against the face of the mine roof upon movement of the head member towards the face of the mine roof.

15. The mine roof bolt assembly of claim 14, wherein:

(a) said first means is resin for adhesively securing said shank to the mine roof.

16. The mine roof bolt assembly of claim 14, wherein:

(a) said stop means comprises a plug of disk shape.

17. The mine roof bolt assembly of claim 16, wherein:

(a) said second means comprises a threaded periphery on said plug which is in threaded engagement with the threaded bore of said head member.

18. The mine roof bolt assembly of claim 16, wherein:

(a) said third means comprises a roof support plate.

* * * * *